US012163772B2

(12) United States Patent
Shakaruka

(10) Patent No.: US 12,163,772 B2
(45) Date of Patent: Dec. 10, 2024

(54) DISRUPTER AND AMMUNITION FOR NEUTRALIZING IMPROVISED EXPLOSIVE DEVICES

(71) Applicant: The State of Israel, Israel National Police, Jerusalem (IL)

(72) Inventor: Zeev Shakaruka, Ramat-Gan (IL)

(73) Assignee: The State of Israel, Israel National Police, Jerusalem (IL)

( * ) Notice: Subject to any disclaimer, the term of this patent is extended or adjusted under 35 U.S.C. 154(b) by 0 days.

(21) Appl. No.: 17/923,014

(22) PCT Filed: May 3, 2021

(86) PCT No.: PCT/IL2021/050502
§ 371 (c)(1),
(2) Date: Nov. 3, 2022

(87) PCT Pub. No.: WO2021/224910
PCT Pub. Date: Nov. 11, 2021

(65) Prior Publication Data

US 2023/0160673 A1 May 25, 2023

(30) Foreign Application Priority Data

May 3, 2020 (IL) ..... 274417

(51) Int. Cl.
*F41A 25/12* (2006.01)
*F41A 21/36* (2006.01)
(Continued)

(52) U.S. Cl.
CPC ..... *F42D 5/04* (2013.01); *F41A 21/36* (2013.01); *F41A 25/12* (2013.01); *F41A 27/24* (2013.01)

(58) Field of Classification Search
CPC ..... F41A 27/24; F41A 25/10; F41A 25/12; F41A 21/36; F42D 5/04
(Continued)

(56) References Cited

U.S. PATENT DOCUMENTS 378,314 A 2/1888 Hill
6,343,536 B1 * 2/2002 Rossier ..... F41A 25/18 89/129.01
(Continued)

FOREIGN PATENT DOCUMENTS

EP 0178039 4/1986
GB 2438212 A * 11/2007 ..... F41B 9/0046
(Continued)

OTHER PUBLICATIONS

Office Action Dated Apr. 30, 2023 From the Israel Patent Office Re. Application No. 274417. (4 Pages).
(Continued)

*Primary Examiner* — John Cooper

(57) ABSTRACT

A disrupter includes a barrel through which a projectile is fired; a barrel housing including a sleeve, the sleeve configured to receive the barrel and allow movement of the barrel therethrough; a frame on which the barrel housing together with the barrel may be selectively pivoted, the barrel configured to move relative to the frame during recoil of the barrel; and a stand on which the frame is supported, the stand including a pair of telescopic legs configured to extend in a direction parallel to a surface on which the disrupter is positioned, wherein telescopic extensions of the legs extend in a direction opposite a direction of firing; wherein the telescopic extensions are configured to extend prior to the firing and are configured to telescopically collapse during recoil of the barrel, the telescopic construc-
(Continued)

tion accompanied by a resisting force configured to absorb recoil energy as the telescopic legs collapse.

20 Claims, 7 Drawing Sheets

(51) Int. Cl.
*F41A 27/24* (2006.01)
*F42D 5/04* (2006.01)

(58) Field of Classification Search
USPC ..... 86/50
See application file for complete search history.

(56) References Cited

U.S. PATENT DOCUMENTS 10,240,884 B1 * 3/2019 De Leon ..... F41A 25/10
10,254,076 B2 * 4/2019 Penrod ..... F41A 23/02
2006/0048668 A1 * 3/2006 Williams ..... F42B 12/50 102/513
2011/0000363 A1 * 1/2011 More ..... F41H 11/16 89/43.01
2016/0102945 A1 4/2016 Itzkowitz
2017/0138713 A1 * 5/2017 Penrod ..... F41A 23/02

FOREIGN PATENT DOCUMENTS

WO WO-2016079349 A1 * 5/2016 ..... B25J 11/0025
WO WO 2021/224910 11/2021

OTHER PUBLICATIONS

International Preliminary Report on Patentability Dated Nov. 17, 2022 From the International Bureau of WIPO Re. Application No. PCT/IL2021/050502. (10 Pages).
International Search Report and the Written Opinion Dated Aug. 25, 2021 From the International Searching Authority Re. Application No. PCT/IL2021/050502. (15 Pages).
Supplementary Partial European Search Report and the European Search Opinion Dated Mar. 27, 2024 From the European Patent Office Re. Application No. 21799616.4. (12 Pages).

* cited by examiner

SECTION B-B

DISRUPTER AND AMMUNITION FOR NEUTRALIZING IMPROVISED EXPLOSIVE DEVICES

RELATED APPLICATIONS

This application is a National Phase of PCT Patent Application No. PCT/IL2021/050502 having International filing date of May 3, 2021, which claims the benefit of priority of Israel Patent Application No. 274417 filed on May 3, 2020. The contents of the above applications are all incorporated by reference as if fully set forth herein in their entirety.

FIELD AND BACKGROUND OF THE INVENTION

The present invention, in some embodiments thereof, relates to an apparatus for neutralizing explosive devices and, more particularly, but not exclusively, to a disrupter and ammunition for neutralizing improvised explosive devices.

Disrupters are used by various military, police and other emergency personnel, to neutralize known or suspected improvised explosive devices (IEDs). A disrupter is typically designed using a barrel similar to a shotgun barrel. A percussion actuated non-electric disrupter (PAN disrupter) is one known type of disrupter. Known disrupters may be used with adjustable stands or without a stand.

An IED is an explosive device that may be cobbled together (or "improvised") for example, from commercial or military explosives, homemade explosives, military ordnance and/or ordnance components, typically by terrorists, guerrillas or commando forces for use in unconventional warfare. IEDs may be designed to be lethal, to cause injury, to destroy or incapacitate structural targets or simply to harass or distract an opponent.

Disabling an IED may present special challenges. An IED may be hidden within other objects or placed among other objects and may therefore be difficult to reach. Furthermore, contents in IED may unpredictable as well as its mode of operation. For example, an IED may be detonated using any one of a fuse, a timer, or by radio-control. It is generally desirable for a disrupter to be compact and quick to setup to help overcome some of the challenges associated with disabling IEDs especially in urban environments.

SUMMARY OF THE INVENTION

According to some aspects of some example embodiments, there is provided a lightweight and compact disrupter configured to fire a projectile. The disrupter may include a barrel through which a projectile is fired, a barrel housing include a sleeve through which the barrel is movably supported, a frame and a stand on which the disrupter rests. Initiation may be electrical, with a shock tube or with an electromagnetic striking pin. One or more of the barrel, sleeve and stand may include features to improve stability and reduce recoil during operation. Optionally, the barrel is a 12-gauge barrel that is versatile in that it may be operated with different types of projectiles.

According to some example embodiments, there is provided a disrupter comprising: a barrel through which a projectile is fired; a barrel housing including a sleeve, wherein the sleeve is configured to receive the barrel and allow movement of the barrel therethrough; at least one spring configured to absorb recoil energy based on the firing;

a frame on which the barrel may be selectively pivoted; and a stand on which the frame is supported.

Optionally, the disrupter includes a compensator mounted on a firing end of the barrel, wherein the firing end is an end of the barrel through which the projectile is fired.

Optionally, the compensator directs streaming of exhaust from the firing away from a downward direction.

Optionally, the compensator is an annular member that is fitted coaxially with the barrel, and wherein the compensator includes openings only on the upper half of the annular member.

Optionally, the openings include at least one opening elongated in a direction parallel to the longitudinal axis of the barrel.

Optionally, the openings include at least one bore oriented at an angle with respect to the longitudinal axis of the barrel.

Optionally, in the at least one bore converges toward the longitudinal axis distal from the firing end of the barrel.

Optionally, the disrupter includes a first spring configured to be compressed in response to movement of the barrel in a direction of firing; and a second spring configured to be compressed in response to movement of the barrel in a direction opposite a direction of firing.

Optionally, the disrupter includes a ring element mounted on a distal end of the barrel, wherein the at least one spring includes a coil spring pressed between the ring and a partitioning wall of the barrel housing, wherein the partitioning wall forms a back face of the barrel housing, wherein the distal end of the barrel is an end distal from a firing end of the barrel and wherein the back face of the barrel housing faces the distal end of the barrel.

Optionally, the distal end of the barrel includes screw threads and wherein the ring is a screw-nut component screwed onto the screw threads.

Optionally, the barrel includes a flange, wherein the at least one spring includes a coil spring pressed between the flange and a partitioning wall of the barrel housing, wherein the partitioning wall forms a back face of the barrel housing.

Optionally, the disrupter includes an end cap mounted on a distal end of the barrel, wherein the distal end of the barrel is an end distal from a firing end of the barrel.

Optionally, the end cap is a blasting cap integrated with a detonator.

Optionally, the distal end of the barrel includes screw threads and the end cap is a screw-nut component screwed onto the screw threads.

Optionally, the end cap includes a bore through which wires from a detonator may be extended therethrough.

Optionally, the stand includes a pair of legs extending in a horizontal direction. Optionally, the pair of legs are telescopic and wherein telescopic extensions of the pair of legs extend horizontally in a direction opposite a direction of firing.

Optionally, the disrupter includes pads on a bottom-facing surface of the pair of legs, wherein the pads are configured to provide traction.

Optionally, telescopic extensions include an end piece configured to provide traction.

Optionally, the barrel is a 12-gauge barrel made from stainless steel.

Optionally, at least one of the barrel housing, the frame and the stand is made of aluminum.

Optionally, the barrel frame includes a grip handle configured for holding the disrupter.

Optionally, the disrupter includes an electric control box mounted on the barrel housing, the electric control box comprising: an operational switch; a safety catch configured to protect the operational switch; a pair of connectors configured to connect to detonating wires; and a pair of connectors configured to connect to a power source.

According to an aspect of some example embodiments, there is provided a projectile configured to neutralize known or suspected improvised explosive devices when fired, the projectile comprising: a cylindrical housing; ceramic sand housed in the cylindrical housing; and a pair of plugs configured to plug each end of the cylindrical housing.

Optionally, the ceramic sand includes alumina particles.

Optionally, the cylindrical housing is plastic.

According to an aspect of some example embodiments, there is provided a disrupter system comprising: a disrupter as described herein above; and a projectile as described herein above.

Unless otherwise defined, all technical and/or scientific terms used herein have the same meaning as commonly understood by one of ordinary skill in the art to which the invention pertains. Although methods and materials similar or equivalent to those described herein can be used in the practice or testing of embodiments of the invention, exemplary methods and/or materials are described below. In case of conflict, the patent specification, including definitions, will control. In addition, the materials, methods, and examples are illustrative only and are not intended to be necessarily limiting.

BRIEF DESCRIPTION OF THE SEVERAL VIEWS OF THE DRAWING(S)

Some embodiments of the invention are herein described, by way of example only, with reference to the accompanying drawings and images. With specific reference now to the drawings and images in detail, it is stressed that the particulars shown are by way of example and for purposes of illustrative discussion of embodiments of the invention. In this regard, the description taken with the drawings and images makes apparent to those skilled in the art how embodiments of the invention may be practiced.

DESCRIPTION OF SPECIFIC EMBODIMENTS OF THE INVENTION

Figure 1A:
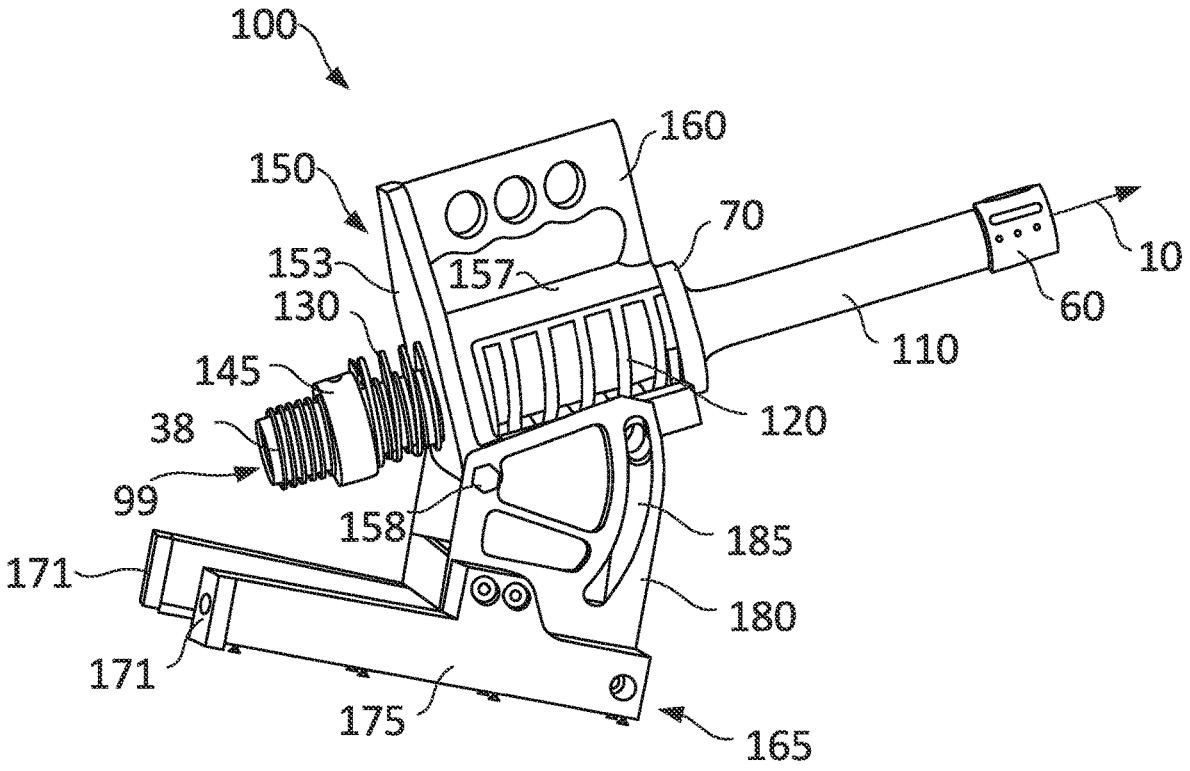
FIGS. 1A and 1B are example disrupters shown without and with an end cap, both in accordance with some example embodiments.

The present invention, in some embodiments thereof, relates to an apparatus for neutralizing explosive devices and, more particularly, but not exclusively, to a disrupter and ammunition for neutralizing improvised explosive devices.

According to some example embodiments, the disrupter includes a barrel movably mounted in a sleeve of a barrel housing, a frame on which the barrel housing may be pivoted to a desired angle and a stand on which the disrupter rests on the ground or other surface. According to some example embodiments, the barrel of the disrupter is floating in that it is configured to move back and forth through the sleeve against a pair of opposing springs and is not fixedly position in the barrel housing e.g., the barrel slides forwards and backwards through the sleeve based on contraction and extension of the pair of springs. Optionally, the pair of opposing springs is a pair of coil springs. In some example embodiments, the barrel oscillate in response to the recoil force felt by the barrel as the springs absorb some of the recoil energy and thereby a distance at which the disrupter is pushed back due to the recoil force is reduced. According to some example embodiments, a range of motion of the barrel through the sleeve is confined by a flange around the barrel that engages the barrel frame on a front face and a ring that is screwed onto a distal end of the barrel and presses a spring against a back face of the barrel frame. Optionally, the ring is used to preload the spring to a desired level and thereby control the recoil felt during operation of the disrupter. More preload leads to more recoil.

According to some example embodiments, the frame provides adjusting an angle of the barrel. Optionally, the frame provides a range of motion of about 0°-60°, e.g. 30° up from a horizontal orientation and 30° down from the horizontal orientation. The barrel may be pivoted to a desired orientation either manually or by remote manipulation. Optionally, a handle is integrated on the sleeve and/or on the barrel housing for easy lifting and maneuvering of the disrupter.

According to some example embodiments, the barrel of the disrupter includes a compensator that directs the exhaust during firing in a desired direction. In some example embodiments, the directional compensator is configured to direct exhaust, e.g. gas from the firing, upwards based on openings, vents or vanes formed on a portion of the compensator that point upwards. Optionally, the openings are solely on the portion of the compensator that point substantially upwards so that the gas is exhausted through the opening with an upward stream as well as through the main drill of the barrel. In some example embodiments at least a portion of the vents are positioned at an angle with respect to the barrel so that the exhaust may be directed backwards (and upwards) with respect to a direction of firing. Optionally, at least one of the vents is oriented parallel to a longitudinal axis of the barrel. According to some example embodiments, the upward stream afforded by the vents in the compensator exerts a downward force on the compensator and may prevent toppling of the disrupter during operation due to the forces of the blast.

According to some example embodiments, the stand includes a pair of telescopic legs that extend in a horizontal direction away from a direction of firing. In some example embodiments, the pair of legs is extended prior to firing and is configured to telescopically collapse as the stand is pushed back during recoil. In some example embodiments, the telescopic construction is designed to be accompanied by a frictional force or other resisting force that is configured to absorb some of the recoil energy as it collapses and thereby reduce the distance that the stand is pushed back due to firing. Optionally, recoil distance of the stand may be between 0.4-0.8 m (depending on the projectile). Optionally, an end of the telescopic extension of the legs includes an end piece configured to provide traction with the surface on which disrupter 100 is positioned and prevent toppling over of the disrupter during recoil.

According to some example embodiments, the disrupter may be configured to be lightweight and compact so that it may be handled and transported manually. Optionally, the disrupter weighs 5-8 kg, e.g. 6 kg. Optionally, the barrel housing, frame and stand are made from aluminum. According to some example embodiments, stability-providing features of the disrupter including for example the directional compensator, the oscillating barrel, and the telescopic legs extending from the stand improve the stability of the disrupter that would otherwise be less stable due to its compact size and relatively lightweight.

In some example embodiments, the disrupter affords manual aim adjustment for up to 1-3 m, e.g. 2 m and aim adjustment with a laser at a distance of up to 20 m or more.

In some example embodiments, a projectile fired with the disrupter is a tube containing ceramic sand, alumina particles, e.g. aluminum oxide or aluminum dioxide. The tube may be a lightweight material, e.g. plastic. Optionally, the disrupter may be operated with different types of projectiles. In some example embodiments, the disrupter includes an end cap configured to cap an end of the barrel distal from the firing end. The end cap may be a passive cap that holds a detonator and/or prevents the projectile and/or fumes from escaping through the distal end during firing. Optionally, the end cap is a blasting cap that includes a detonator integrated therein.

According to some example embodiments, the disrupter is operated with an electric box including an operating switch and connectors for connecting to the detonator and to a power source. Optionally, the electric box is mounted on the barrel frame. Optionally, wires from the detonator extend through a bore in the end cap and are connected a pair of dedicated connectors on the electric box. A power source for actuating the detonation may be connected to an additional pair of connectors. Optionally, the operating switch actuates the detonation and firing of the projectile. Optionally, a safety catch is configured to cover the operating switch to prevent accidental activation of disruptor 100 by unsupervised detonation.

Before explaining at least one embodiment of the invention in detail, it is to be understood that the invention is not necessarily limited in its application to the details of construction and the arrangement of the components and/or methods set forth in the following description and/or illustrated in the drawings and/or the Examples. The invention is capable of other embodiments or of being practiced or carried out in various ways.

Figure 1B:
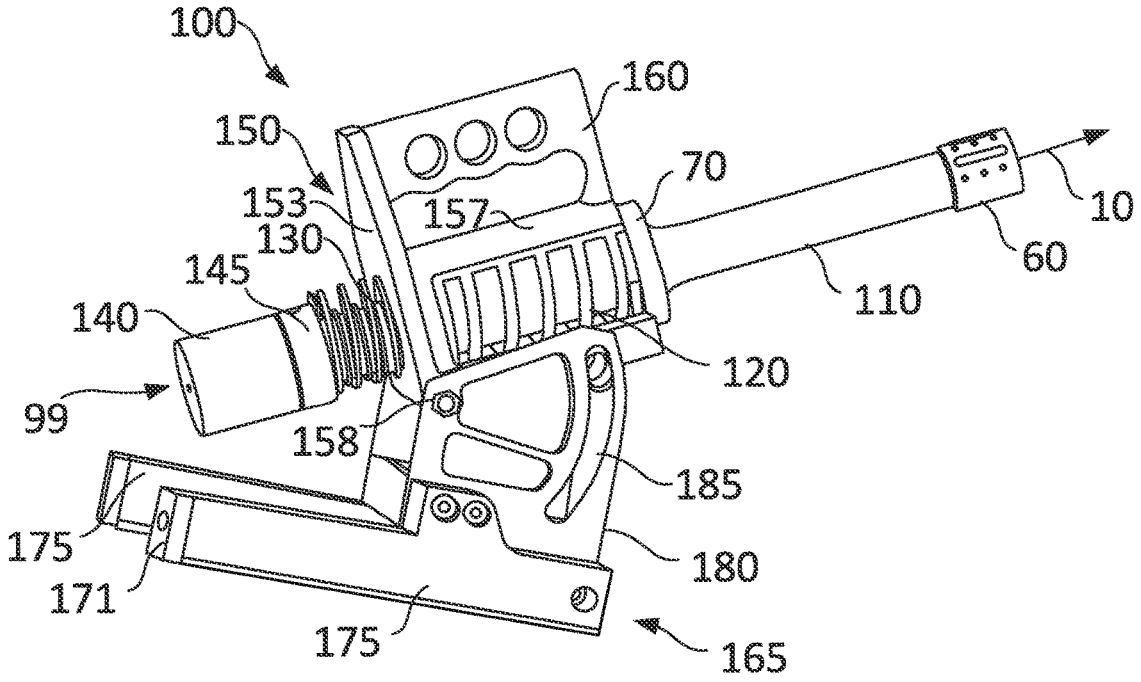
Figure 2:
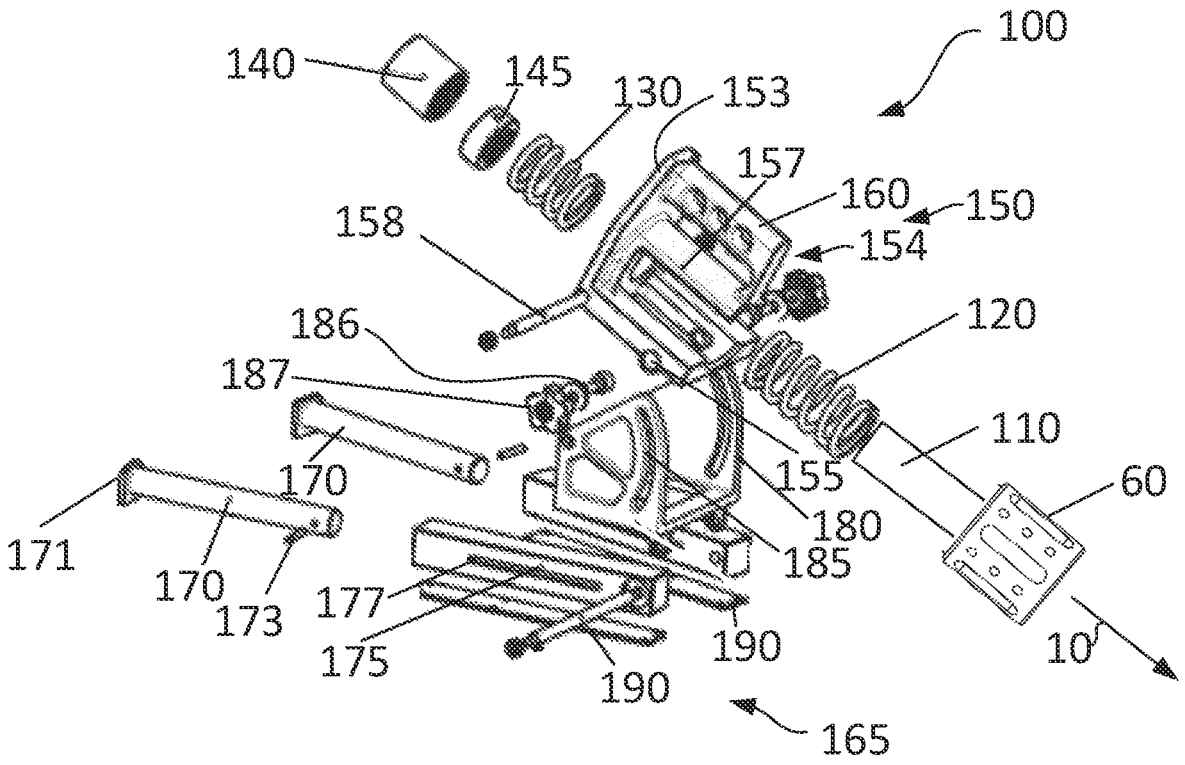
FIG. 2 is an exploded view of an example disrupter in accordance with some example embodiments.

Reference is now made to FIGS. 1A and 1B showing an example disrupter, shown without and with an end cap and to FIG. 2 showing an exploded view of the example disrupter, all in accordance with some example embodiments. According to some example embodiments, a disrupter 100 includes a barrel 110 that is movably mounted through a sleeve 157 of a barrel housing 150. Barrel 110 may be a cylindrical structure with a 12-gauge bore through which a projectile may be fired. Optionally, barrel 110 includes an annular flange 70 that limits movement of barrel 110 through sleeve 157. Optionally, barrel 110 includes screw threads 38 at a distal end 99 on which one or more of a ring 145 and an end cap 140 may be received. One or more of ring 145 and end cap 140 may be a screw-nut component that screws onto screw threads 38.

According to some example embodiments, recoil of barrel 110 based on firing initiates oscillation of barrel 110 through (or with respect to) barrel housing 150. The oscillation is along a longitudinal direction of barrel 100. According to some example embodiments, disrupter 100 includes one or more springs configured to absorb at least part of the recoil force. Optionally and preferably, the recoil force is absorbed with a pair of springs (spring 120 and spring 130), each spring of the pair applying a resilient force in an opposite direction. For example, as barrel 110 slides in firing direction 10, spring 120 compresses and as barrel 110 slides in a direction opposite firing direction 10, spring 130 compresses.

Optionally, barrel housing 150 includes a partitioning wall 153 against which each of spring 120 and spring 130 engage from opposite sides. Optionally, spring 130 is a coil spring pressed between ring 145 and partitioning wall 153. Optionally, spring 120 is a coil spring pressed between flange 70 and partitioning wall 153.

In some example embodiments, ring 145 is manipulated to hold barrel 110 within sleeve 157 at a desired initial position and with a desired preload on spring 130. The initial position of barrel 110 may control the recoil during firing. For example, a larger preload on spring 130 leads to stronger recoil of barrel 110 during firing. Optionally, ring 145 is made of stainless steel and is configured to withstand forces applied by spring 130. Optionally, flange 70 is positioned along barrel 110 so that the desired position prior to firing disrupter 100 coincides with flange 70 being aligned with a front face 154 of sleeve 157, e.g. flange 70 engaging sleeve 157. In this manner, proper alignment of barrel 110 may be apparent to a user on site. Optionally, the alignment is performed manually by manually turning ring 145.

According to some example embodiments, disrupter 100 is operated with an end cap 140 that is configured to be screwed onto barrel 110 with screw threads 38 (FIG. 1B) and thereby fixed onto barrel 110. In some example embodiments, end cap 140 is a passive cap that is configured to cover a distal end of barrel 110 after loading a projecting in barrel 110. Optionally, end cap 140 is aluminum. End cap 140 may prevent the projectile from falling out through distal end 99 and may also prevent fumes from escaping through distal end 99 during firing. In some example embodiments, end cap 140 holds a detonator in proximity to a projectile positioned into barrel 110.

In other example embodiments, end cap 140 is a blasting cap that includes and/or houses a detonator to actuate the firing of a projectile loaded in barrel 110. Optionally, disrupter 100 may be operated with different types of projectiles and based on the projectile, disrupter 100 may be operated with a passive cap, a blasting cap or optionally no end cap 140. For example, when using a projectile that is self-detonating, a passive cap may be used. Alternatively, a blasting cap may be used.

According to some example embodiments, a firing end 10 of barrel 110 is fitted with a compensator 60. Compensator 60 provides for directing exhaust from the firing to a desired direction and is described in further detail herein.

In some example embodiments, barrel housing 150 is pivotally supported on a frame 180. Optionally, the pivotal support is with a hinge pin 158 and a slot 185 displaced from hinge pin 158 that receives a pin 186. Pin 186 may extend through slot 185 and into barrel housing 150 through a bore 155. A desired angle of barrel 110 is selected based on sliding pin 186 along slot 185. A handle 187 fitted on pin 186 may be manually manipulated to lock pin 186 to a desired position along slot 185. Optionally, a screw motion provides securing or locking pin 186 to the desired position. Optionally and preferably, frame 180 includes a pair of slots 185 on opposite sides of frame as well as a pair of pins 186, each with handle 187. A pivot angle may be secured by locking one or both of pins 186 with handles 187. In some example embodiments, pivoting of barrel 110 may be remotely controlled with a motor engaged with one of pins 186 and configured to slide the pin along slot 185. Optionally, slot 185 provides a pivot range of −30° to +30°. According to some example embodiments, frame 180 is fixedly mounted on a stand 165.

According to some example embodiments, stand 165 includes a pair of legs 175 oriented to extend parallel to a surface on which disrupter is positioned. Optionally, an undersurface of legs 175 includes pads 190 that provide traction with a surface on which disrupter 100 stands. Optionally, traction pads 190 are made of a hard material, e.g. iron that can withstand wear and tear. Optionally and preferably, pair of legs 175 are telescopic, including telescopic extensions 170. According to some example embodiments, telescopic extensions 170 extend in a direction generally opposite firing direction 10 and parallel to the surface on which disrupter 100 stands.

According to some example embodiments, telescopic extensions 170 are extended prior to firing disrupter 100. During firing, the recoil force on disrupter 100 may push disrupter 100 and due to the backward movement of disrupter 100, telescopic extensions 170 may collapse into legs 175. In some example embodiments, it may be desirable to affect a frictional force between telescopic extensions 170 and legs 175 that may absorb a portion of the recoil energy of disrupter 100 as telescopic extensions 170 collapse into legs 175. A resistance to collapsing of telescopic extensions into legs 175 may be selected to provide a desired level of absorption. In some example embodiments, legs and telescopic extensions 170 are made of aluminum. Optionally, legs 175 with telescopic extensions 170 in an extended state may have a substantially same length as barrel 110 or longer.

In some example embodiments, sliding of telescopic extensions 170 in and out of legs 175 may be guided by a pin 173 sliding along slot 177 of leg. According to some example embodiments, an end piece 171 fitted on telescopic extensions 170 may provide traction with the surface on which disrupter 100 is positioned. Optionally, end piece 171 includes claws configured to dig into the ground. Optionally, end piece 171 additionally provides stability to disrupter 100 to prevent disrupter 100 from toppling over during recoil. Optionally, end piece 171 is made of steel, e.g. 4340 alloy steel or iron.

According to some example embodiments, disrupter 100 is configured to be lightweight, compact and portable. In some example embodiments, weight of disrupter 100 may be 4-8 kg, e.g. 6 kg. In some example embodiments, barrel 110 is stainless steel while the barrel housing 150, frame 180 and stand 165 is a lighter material, e.g. aluminum. Optionally, barrel housing 150 includes a handle 160 that may be used to carry and move disrupter 100 to a desired location.

Figure 3A:
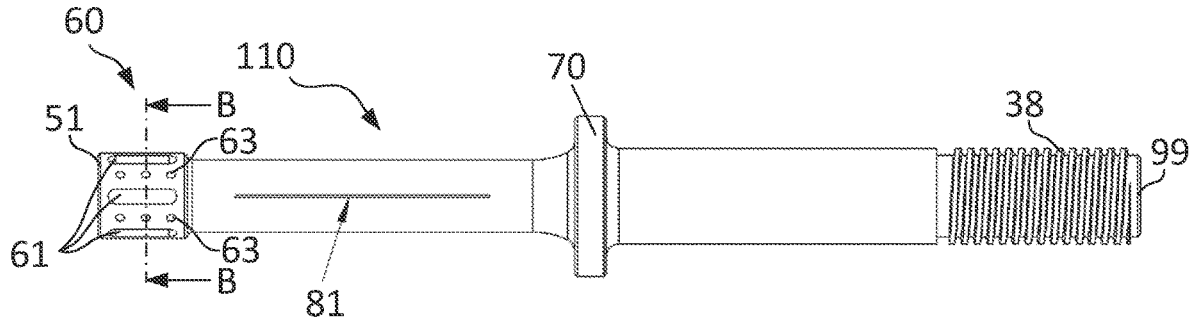
FIGS. 3A and 3B are top and cross sectional views of an example barrel, the cross section cut through an example compensator of the barrel, both in accordance with some example embodiments.
Figure 3B:
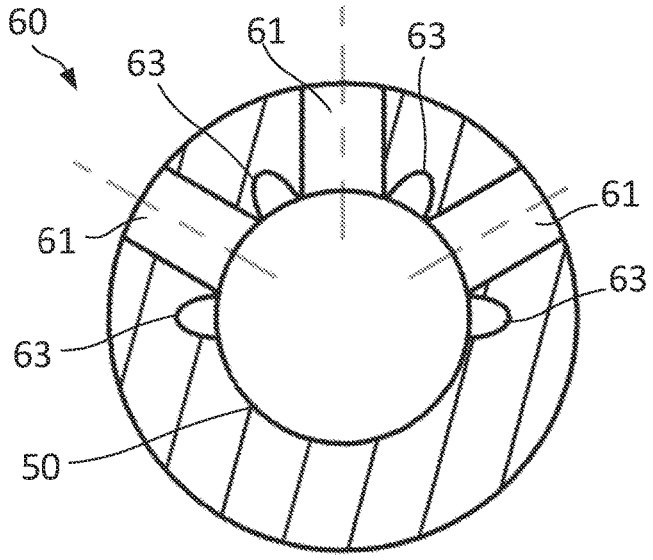

Reference is now made to FIGS. 3A and 3B showing an example top view and cross sectional cut through a compensator of an example barrel with compensator, both in accordance with some example embodiments. A barrel 60 may be for example a 12-gauge barrel suitable for firing a plurality of different projectiles. In some example embodiments, barrel 110 has a length of 30-50 cm, e.g. 41 cm with a central drill 50 through which a projectile may be fired. Optionally, a line 81 engraved along a length of barrel 60 is used to aim when preparing to shoot. In some example embodiments, a proximal end 51 of barrel 110 includes a compensator 60.

According to some example embodiments, compensator 60 is an annular element with openings formed in the upper half and no openings formed in the bottom half. According to some example embodiments, compensator 60 directs exhaust gasses upwards through through-going holes during firing and thereby actuates pushing proximal end 51 in a downwards direction during firing. Optionally, the through-going holes include one or more slots 61 elongated in a direction parallel to a longitudinal axis of barrel 110 and a plurality of bores 63 extending through annular wall of compensator 60 at a non-normal angle. Optionally, compensator 60 also directs exhaust gasses backwards in relation to direction of firing 10. Optionally, bores 63 extend central drill 50 outwards in a direction away from proximal end 51 and generally toward distal end 99. In some example embodiments, bores 63 extend through the annular wall of compensator 60 at a 30°-60° angle, e.g. 60° or 45° with respect to a longitudinal axis of barrel.

Figure 4:
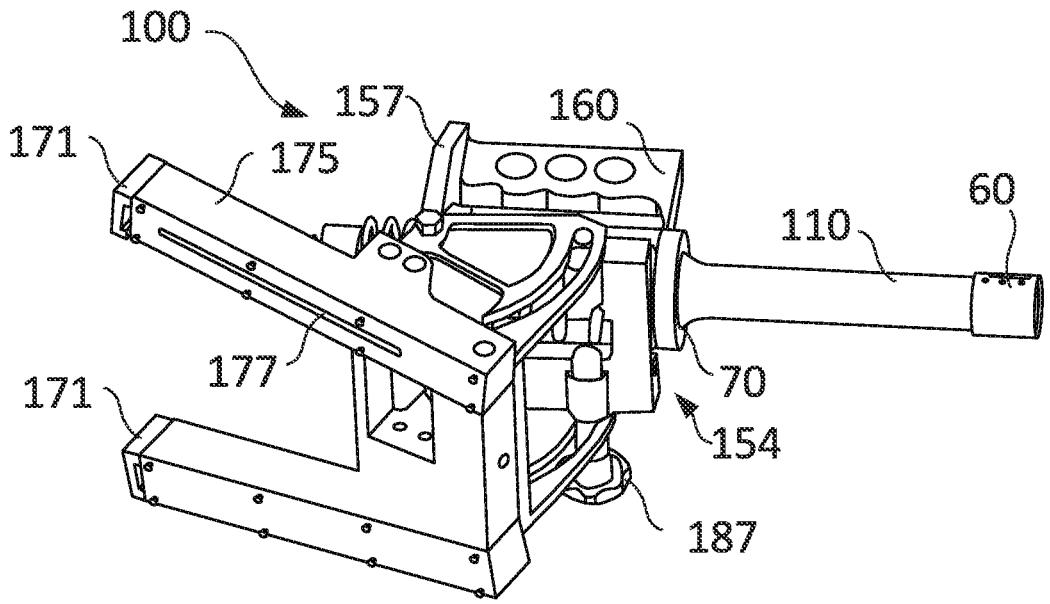
FIG. 4 shows a bottom perspective view of an example disrupter in accordance with some example embodiments.

FIG. 4 shows a different perspective view of an example disrupter, in accordance with some example embodiments. In some example embodiments, slot 177 in leg 175 is positioned on a bottom face of leg 175 and covered with traction pad 190. In FIG. 4, one leg 175 is shown without traction pad 190 so that slot 177 is revealed and the other leg 175 is shown with traction pad 190. The present inventors have found that it is preferably to position slot 177 on a bottom face of leg 175 and covered with it traction pad to avoid debris from entering through slot 177 and potentially obstructing movement of telescopic extensions 170 extending from legs 175.

Figure 5A:
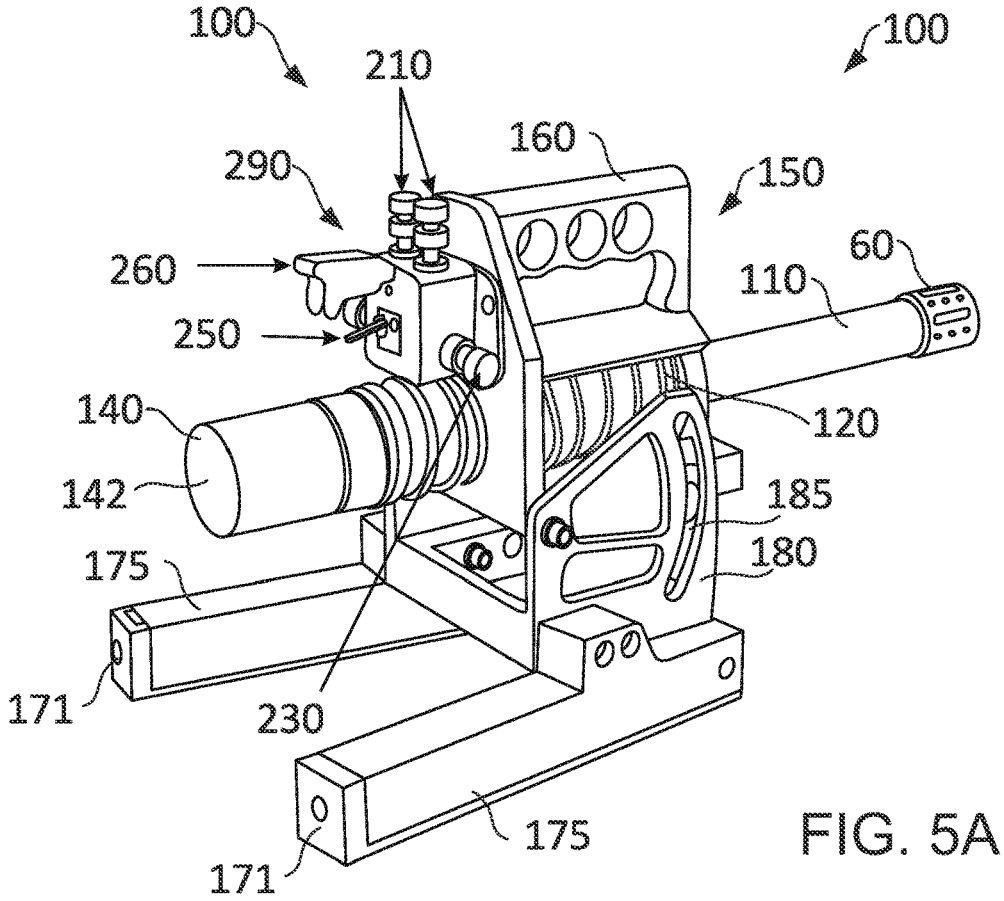
FIGS. 5A and 5B are perspective views of an example disrupter including an operational switch with a safety catch, the safety catch shown in two different positions, both in accordance with some example embodiments.
Figure 5B:
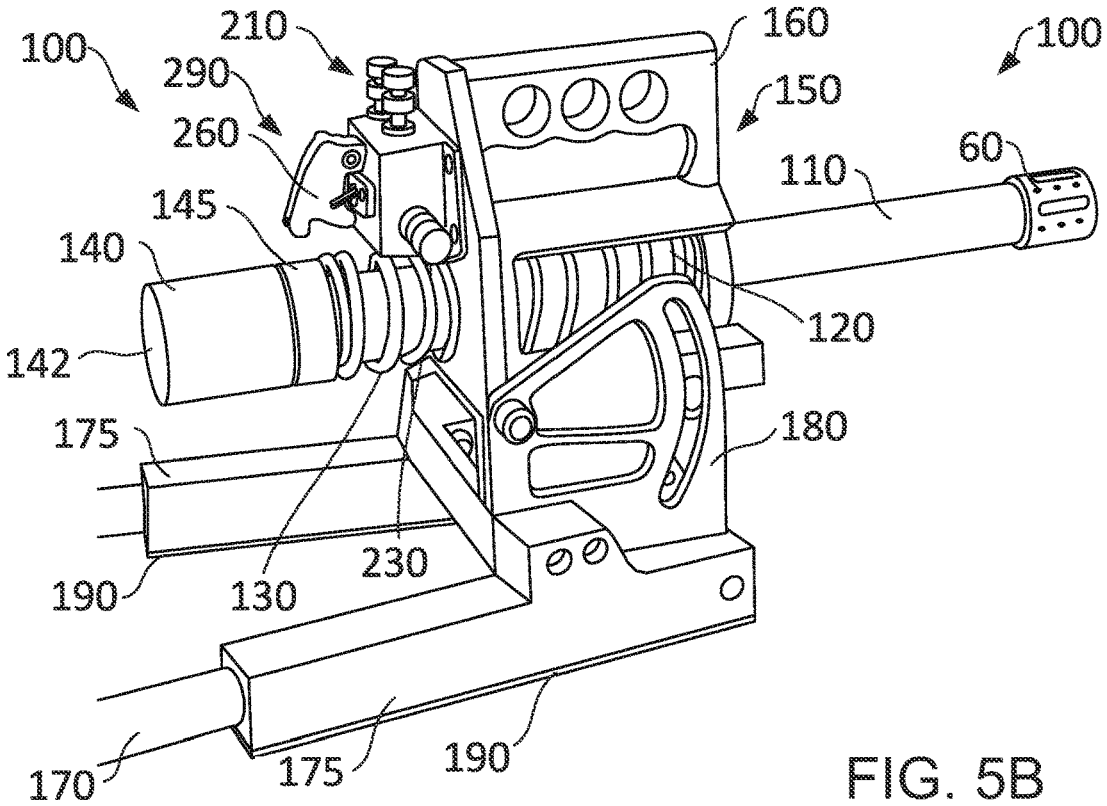

FIGS. 5A and 5B are perspective views of an example disrupter including an operational switch with a safety catch, the safety catch shown in two different positions, both in accordance with some example embodiments. According to some example embodiments, disrupter 100 includes an electric box 290 including an operational switch 250, a safety catch 260 and connectors 210 and 230. According to some example embodiments, an end cap 140 includes a hole 142 through which a pair of wires is extended. The pair of wires (not shown) may extend from a detonator housed in end cap 140, integrated into end cap 140 or integrated with a projectile within barrel 110. In some example embodiments, during operation, the pair of wires is connected to a first pair of connectors 230 on electric box 290. A second pair of wires extending from a power source may be connected to connectors 210. Operational switch 250 electrically connects wires attached to connectors 230 to the wires attached to connectors 210 and thereby actuate firing with disrupter 100. A safety catch 260 may be a hood that covers operational switch 250 and thereby prevent accidental activation of disruptor 100 by unsupervised detonation. In some example embodiments, disrupter 100 may also be actuated remotely.

Figure 6:
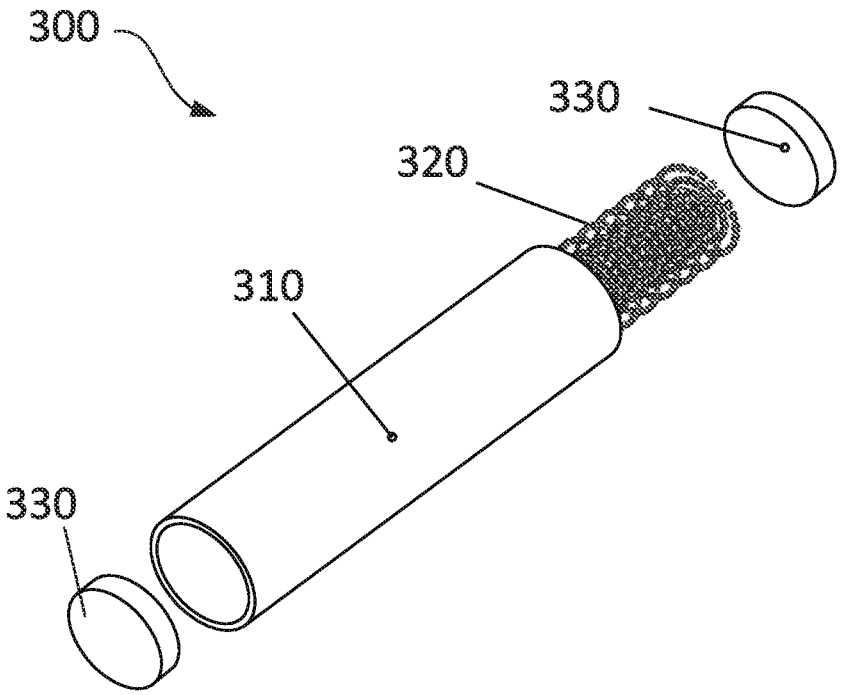
FIG. 6 is a schematic exploded view of an example projectile configured for use with an example disrupter in accordance with some example embodiments.

Reference is now made to FIG. 6 showing a schematic exploded view of an example projectile configured for use with an example disrupter in accordance with some example embodiments. Various types of projectiles may be fired with barrel 110. In some example embodiments, a projectile 300 includes a cylindrical housing 310 filled with ceramic sand 320, e.g. alumina or aluminum oxide, argyle, or metals such as zinc and copper. Aluminum oxide may operate at a relatively more concentrated range that may be more suitable for handling IEDs in an urban setting. In the some example embodiments, a projectile with ceramic sand 320 provides tearing IED to pieces as well as cutting through textile materials. The cylindrical housing may include a plug 330 at each end to seal contents of projectile 300. Optionally, housing 310 is made from a polymer and plugs 330 may be a rubber material or a polymer with elastic properties. A length of projectile 300 may be 6 cm-9 cm, e.g. 7.5 cm and an outer diameter of projectile 300 may be 1.5-2 cm. e.g. 1.8 cm.

It is appreciated that certain features of the invention, which are, for clarity, described in the context of separate embodiments, may also be provided in combination in a single embodiment. Conversely, various features of the invention, which are, for brevity, described in the context of a single embodiment, may also be provided separately or in any suitable sub-combination or as suitable in any other described embodiment of the invention. Certain features described in the context of various embodiments are not to be considered essential features of those embodiments, unless the embodiment is inoperative without those elements.

Various embodiments and aspects of the present invention as delineated hereinabove and as claimed in the claims section below find experimental support in the following examples.

EXAMPLES

Reference is now made to the following examples, which together with the above descriptions illustrate some embodiments of the invention in a non-limiting fashion.

Figure 7A:
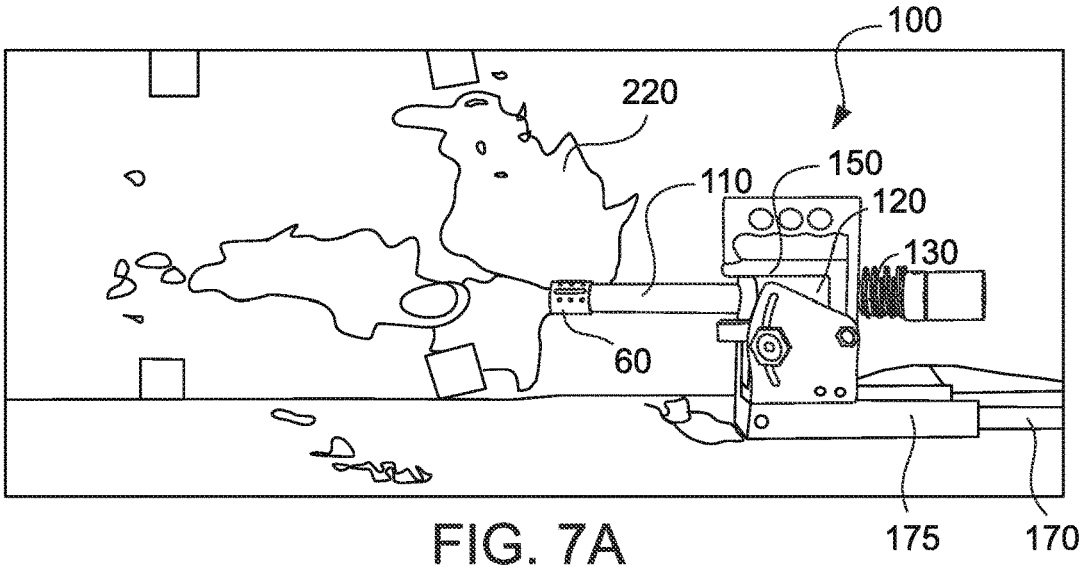
FIGS. 7A, 7B and 7C are three time consecutive images during operation of an example disrupter, all according to some example embodiments.
Figure 7B:
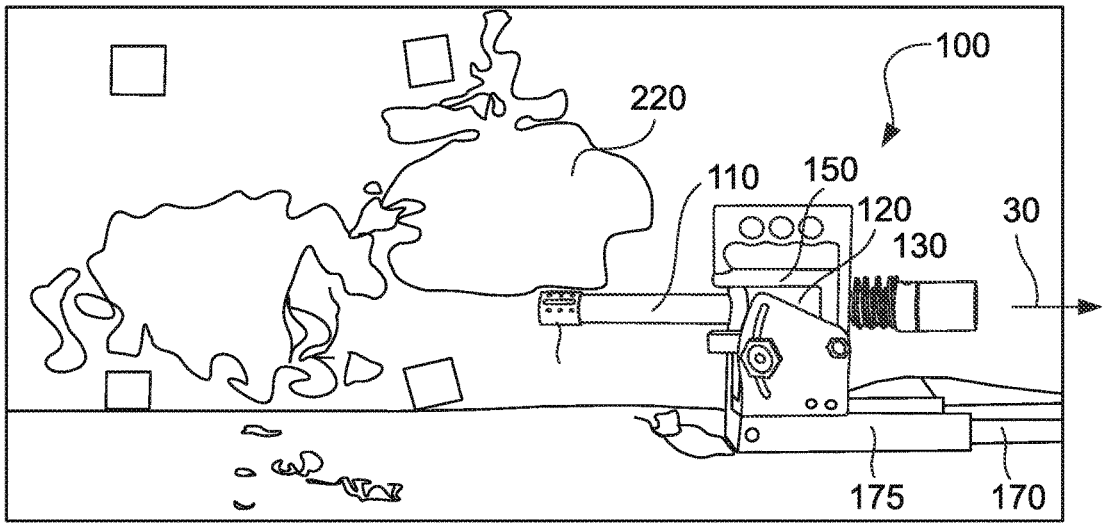
Figure 7C:
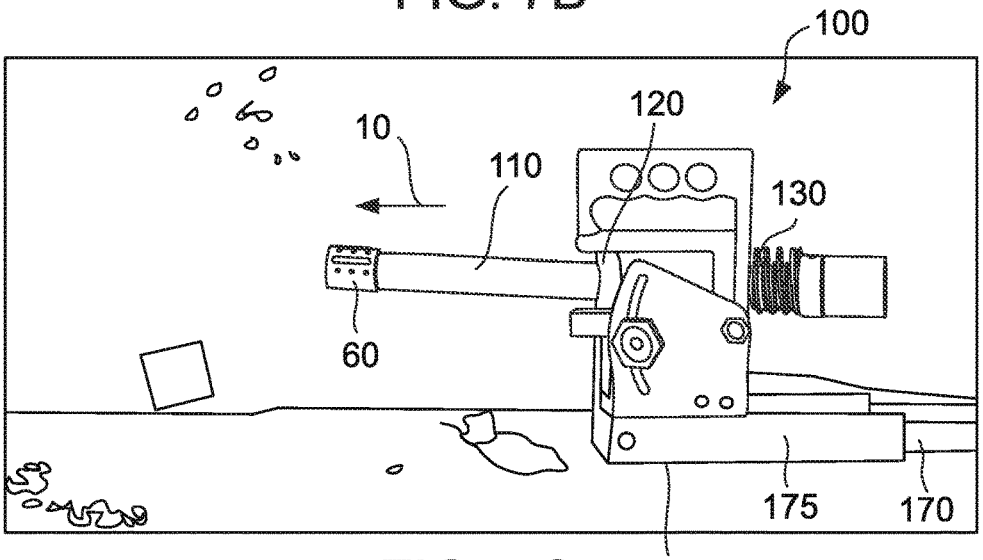

FIGS. 7A, 7B and 7C are three time consecutive images showing movement of an example disrupter in operation, all according to some example embodiments. In each of FIGS. 7A and 7B, an example disrupter 100 is shown to exhaust gasses 220 from the firing in an upward direction through compensator 60 of barrel 110. The upward stream of exhaust 220 may be harnessed to increase the downward force on barrel 110 near compensator 60 and prevent upward tilting or toppling over of disrupter 100 that may otherwise occur. This may improve stability to disrupter 100 without increasing the overall weight and dimensions of the disrupter.

In FIG. 7B, barrel 110 is shown to move backwards (in direction 30) in relation to barrel housing 150 based on which the rear spring coil 130 stretches. Stretching of rear coil 130 in comparison to rear coil 130 in FIG. 7A may be depicted in FIG. 7B. Backwards movement (in direction 30) of barrel 110 is recoil in response to the firing. As rear spring coil 130 is stretched (or extended), the front spring coil 120 is compressed. Energy stored in both front spring coil 120 and rear spring coil 130 initiates oscillation of barrel 110 with respect to sleeve 157.

In FIG. 7C forward movement of barrel 110 may be depicted (in direction 10). The forward movement is due to the energy stored in the coil springs that pushes the barrel forward. As can be seen, this forward movement is accompanied by compression of rear coil 130 and stretching of front coil 120. The oscillatory movement may continue over a plurality of cycle until the oscillation is damped. During oscillation, rear spring coil 130 may absorb a portion of the recoil energy from the firing and thereby reduce the backwards movement of disrupter 100 during operation. As described herein above, some of the recoil energy may also be absorb with friction during telescopic movement of the leg extensions 170 during recoil. Some backwards movement of disrupter 100 due to the recoil force may be depicted in FIG. 7C. In some example embodiments, the backwards movement may be between 0.4-0.8 meters or less depending on the projectile fired. This relatively little movement is advantageous when dealing with IEDs neutralization, since IEDs may be often found urban environments that may be crowded with obstacles that may be time consuming and/or difficult to clear. By reducing the recoil, disrupter 100 may be operated with less disturbances to the surrounding environment.

Although the invention has been described in conjunction with specific embodiments thereof, it is evident that many alternatives, modifications and variations will be apparent to those skilled in the art. Accordingly, it is intended to embrace all such alternatives, modifications and variations that fall within the broad scope of the appended claims.

In addition, any priority document(s) of this application is/are hereby incorporated herein by reference in its/their entirety.

What is claimed is:

1. A disrupter configured to be positioned on a surface, said disrupter comprising:

a barrel through which a projectile is fired;

a barrel housing including a sleeve, wherein the sleeve is configured to receive the barrel and allow movement of the barrel therethrough;

a frame on which the barrel housing together with the barrel may be selectively pivoted, wherein said barrel is configured to move relative to said frame during recoil of said barrel; and a stand on which the frame is supported, said stand including a pair of legs having a telescopic construction, said legs configured to extend in a direction parallel to the surface on which said disrupter is positioned, wherein telescopic extensions of said legs extend in a direction opposite a direction of firing;

wherein said telescopic extensions of said telescopic legs are configured to be extended prior to the firing and wherein said telescopic legs are configured to telescopically collapse during the recoil of the barrel, said telescopic construction accompanied by a resisting force configured to absorb recoil energy as the telescopic legs collapse.

2. The disrupter of claim 1, comprising a compensator mounted on a firing end of the barrel, wherein the firing end is an end of the barrel through which the projectile is fired.

3. The disrupter of claim 2, wherein the compensator directs streaming of exhaust from the firing away from a downward direction.

4. The disrupter of claim 2, wherein the compensator is an annular member that is fitted coaxially with the barrel, and wherein the compensator includes openings only on the upper half of the annular member.

5. The disrupter of claim 4, wherein the openings include one of:

at least one opening elongated in a direction parallel to the longitudinal axis of the barrel; and at least one bore oriented at an angle with respect to the longitudinal axis of the barrel.

6. The disrupter of claim 5, wherein the at least one bore converges toward the longitudinal axis distal from the firing end of the barrel.

7. The disrupter of claim 1 including at least one spring configured to absorb recoil energy based on the firing, said at least one spring comprising:

a first spring configured to be compressed in response to movement of the barrel in a direction of firing; and a second spring configured to be compressed in response to movement of the barrel in a direction opposite a direction of firing.

8. The disrupter of claim 1, including at least one spring configured to absorb recoil energy based on the firing, said disrupter further comprising a ring element mounted on a distal end of the barrel, wherein the at the least one spring includes a coil spring pressed between the ring and a partitioning wall of the barrel housing, wherein the partitioning wall forms a back face of the barrel housing, wherein the distal end of the barrel is an end distal from a firing end of the barrel and wherein the back face of the barrel housing faces the distal end of the barrel.

9. The disrupter of claim 1, including at least one spring configured to absorb recoil energy based on the firing, wherein the barrel includes a flange, wherein the at least one spring includes a coil spring pressed between the flange and a partitioning wall of the barrel housing, wherein the partitioning wall forms a back face of the barrel housing.

10. The disrupter of claim 1, comprising an end cap mounted on a distal end of the barrel, wherein the distal end of the barrel is an end distal from a firing end of the barrel, and wherein the end cap is a blasting cap integrated with a detonator.

11. The disrupter of claim 1, wherein said resisting force is a frictional force.

12. The disrupter of claim 1, wherein a resistance to collapsing of said telescopic extensions is selectable.

13. The disrupter of claim 1, comprising pads on a bottom-facing surface of the pair of legs, wherein the pads are configured to provide traction.

14. The disrupter of claim 1, wherein telescopic extensions include an end piece configured to provide traction.

15. The disrupter of claim 1, wherein the barrel frame includes a grip handle configured for holding the disrupter.

16. The disrupter of claim 1, including an electric control box mounted on the barrel housing, the electric control box comprising:

an operational switch a safety catch configured to protect the operational switch;

a pair of connectors configured to connect to detonating wires; and a pair of connectors configured to connect to a power source.

17. The disrupter of claim 1, wherein said frame includes a slot and wherein an angle of pivot of said barrel is selectable based on sliding of a pin along said slot.

18. A disrupter system comprising:

a disrupter according to claim 1; and a projectile configured to neutralize known or suspected improvised explosive devices when fired, the projectile comprising:

a cylindrical housing;

ceramic sand housed in the cylindrical housing; and a pair of plugs configured to plug each end of the cylindrical housing.

19. The system of claim 18, wherein the ceramic sand includes alumina particles.

20. The system of claim 18, wherein the cylindrical housing is plastic.

* * * * *